United States Patent [19]

Stücheli et al.

[11] 4,284,688

[45] Aug. 18, 1981

[54] MULTI-LAYER, HIGH-TEMPERATURE CORROSION PROTECTION COATING

[75] Inventors: Albin Stücheli, Zurich; Walter Trindler, Lengnau, both of Switzerland

[73] Assignee: BBC Brown, Boveri & Company Limited, Baden, Switzerland

[21] Appl. No.: 99,708

[22] Filed: Dec. 3, 1979

[30] Foreign Application Priority Data

Dec. 21, 1978 [CH] Switzerland ..... 12995/78
Dec. 21, 1978 [CH] Switzerland ..... 12996/78

[51] Int. Cl.[3] ..... B22F 7/04; B22F 7/08

[52] U.S. Cl. ..... 428/559; 428/667; 428/668; 428/678; 428/926; 75/126 R; 75/128 Z; 75/134 F; 75/171; 427/405

[58] Field of Search ..... 148/6.16, 6.2, 31.5; 428/668, 678, 667, 926, 559; 75/126 R, 171, 134 F, 128 Z; 427/405

[56] References Cited

U.S. PATENT DOCUMENTS

| | | | |
|---|---|---|---|
| 2,412,977 | 12/1946 | Eskin | 428/667 |
| 2,854,739 | 10/1958 | Bartlett et al. | 428/667 |
| 2,859,158 | 11/1958 | Schaer | 428/667 X |
| 2,928,169 | 3/1960 | Beach et al. | 428/667 X |
| 3,542,530 | 11/1970 | Talboom et al. | 428/926 X |
| 3,676,085 | 7/1972 | Evans et al. | 427/292 X |
| 4,101,713 | 7/1978 | Hirsch et al. | 428/554 |

FOREIGN PATENT DOCUMENTS 1202619 8/1970 United Kingdom .

*Primary Examiner*—P. C. Ives
*Attorney, Agent, or Firm*—Oblon, Fisher, Spivak, McClelland & Maier

[57] ABSTRACT

Multi-layer, high-temperature corrosion protection coat for a corrodible metallic surface which comprises: (1) a first layer adjacent to the metallic surface comprising 1–15% zirconium, 10–30% chromium and remainder nickel; and (2) a second layer adjacent to said first layer comprising at least 60% chromium and remainder selected from the group consisting of iron, iron plus nickel and mixtures thereof. The protective coatings can be used in machine and appliance construction, particularly for components of thermal engines under high thermal and corrosive stress. They are resistant to sulfidization and oxidation.

11 Claims, 6 Drawing Figures

MULTI-LAYER, HIGH-TEMPERATURE CORROSION PROTECTION COATING

BACKGROUND OF THE INVENTION

1. Field of the Invention

The present invention relates to a multi-layer, high-temperature corrosion protection coat for metallic surfaces.

2. Description of the Prior Art

Corrosion protection coatings for high operating temperatures are generally used in machine construction. The main field of application of such high-temperature protection coatings is found in the area of thermal fluid flow engines, particularly on components subject to high stress, such as gas turbine blades. These coatings serve the purpose of extending the life of the protected high-temperature materials.

The protective coatings known to the prior art are, in general, based on the protective effect of the oxides of chromium, aluminum and silicon, as well as alloying elements (yttrium), either individually or in combination (see for example, U.S. Pat. No. 3,676,085; U.S. Pat. No. 2,754,903; U.S. Pat. No. 3,542,530; German Pat. No. 2,520,192). Prior art coatings are also based on silicate layers based on Ni/Cr/Si/B alloys (see for example, Villat, M., Felix, P., "High-Temperature Corrosion Protection Coating for Gas Turbines", Technische Rundschau Sulzer 3, 1976, Pages 97 to 104).

The customary corrosion protection coatings for high-temperature applications are mostly specifically designed for resistance against certain corrosive agents. However, in the cases of corrosion by a multiplicity of agents, the anti-corrosive behavior of prior art coats is usually unsatisfactory. Thus, the protective coatings made from Cr, Al and Si have generally favorable characteristics in oxidizing atmospheres but fail in the presence of relatively high amounts of sulfur and fuel gases.

Because of their poor resistance to sulfidization, such prior art coatings require the use of relatively pure fuels, a fact which restricts their field of application. Additionally, such protective coatings are often deficient in chemical-physical compatibility with the base material to be protected, whereby the coatings tend to crack and peel. On the other hand, coatings on the basis of Ni/Cr/Si/B are generally quite compatible with the base material but do not have optimum corrosion behavior.

A need therefore continues to exist for a high-temperature corrosion protection coating with staggered protective effect for high operating temperatures which has increased sulfidization resistance with good oxidation resistance at high temperatures. Such a protective coating should have good physical-chemical compatibility with the base material which it covers and should be suitable for the production of solid solutions.

SUMMARY OF THE INVENTION

It is therefore an object of the invention to provide a high-temperature corrosion protection coat for corrodible metallic surfaces.

A further object of the invention is to provide a corrosion coat which has high sulfidization resistance.

Still a further object of the invention is to provide a corrosion coat having good oxidation resistance at high temperatures.

These and other objects of the invention which will hereinafter become more readily apparent have been attained by providing a multi-layered high-temperature corrosion coat for a corrodible metallic surface which comprises:

(1) a first layer adjacent to said metallic surface comprising 1–15% zirconium, 10–30% chromium and remainder nickel; and (2) a second layer adjacent to said first layer comprising at least 60% chromium and remainder selected from the group consisting of iron, iron plus nickel, and mixtures thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
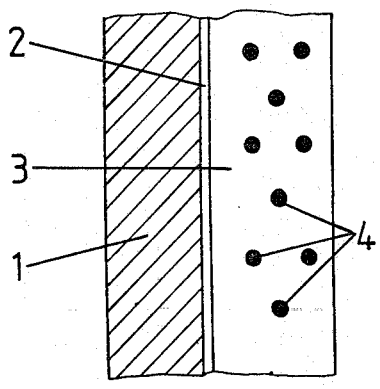
FIG. 1 shows the cross-section through a protection coating after the first two layers are applied. Directly on top of the base material 1, which can for example, consist of a super-alloy, is first applied a thin first nickel intermediate coating 2, improving adhesiveness. On top of this thin first nickel intermediate coating 2, follows the coating, serving subsequently as the carrier for protective zone I. The protective zone I consists of a nickel matrix 3 into which finely dispersed zirconium particles 4 are embedded.

It has been determined that very high values of corrosion resistance can be achieved with zirconium/chromium/nickel alloys which, if necessary, may contain other additions. This is generally applicable to alloys of the following composition:

1–15% Zr
10–30% Cr
Remainder Ni

In this context, up to 80 relative % of the zirconium can be replaced by titanium. Yttrium, lanthanum, rare earth and/or beryllium, in contents of 0.05 to 2% can be present in an advantageous manner as additional elements for further improvement of the anti-corrosive properties of the basic alloy. Depending on the process of production of the alloy, furthermore, sinter additions, such as silicon in contents of up to approximately 4% (preferably 3–4%) and boron up to approximately 2% (preferably 1.5–2%), can be included.

The Zr/Cr/Ni alloys of the invention can be favorably combined with pure Cr layers, or Cr/Fe layers, and/or Cr/Fe/Ni layers having a high Cr content to form multi-layer corrosion protection coatings with a favorable zone structure and long-time behavior. Such protective coatings, built in a staggered way, have a long life and a targeted specific anti-corrosion behavior which can be influenced with time. The zone structure of such protective coatings can be expediently controlled by means of intended diffusion processes during the production of the coats themselves (thermal treatment), as well as during operation.

A multi-layer coating can, for example, consist of a first zone on the basis of Zr/Cr/Ni as well as an additional zone on the basis of Cr. However, any suitable combination of customary types of coatings can, in principle, be prepared together with the Zr/Cr/Ni alloy of this invention.

In the initial stage of the corrosive attack, the outer zone first takes over the corrosion protection. Only when, due to the progressive corrosion or due to other influences, this outer zone is no longer effective, the corrision protection of the object is taken over by the subject zone below the outer one.

The production of multi-layer coatings can, in principle, be carried out by means of any combination of actually known process, such as plasma and flame spraying with sinters, galvanic processes, pack cementing, electrochemical separation from fused salt baths, separation from powder suspensions, physical or chemical separation from the gas phase, pyrolysis, plating, or the like.

Multi-layer protective coatings of a deviating composition can also be produced according to the described process. For example, a first protective zone I, can, quite generally, consist of a Zr/Cr/Ni alloy of a variable or approximately constant composition within the limits 1–15% Zr, 10–30% Cr and the remainder Ni. Further additive elements, such as beryllium, yttrium, rare earths, silicon and boron can be contained therein up to an approximate maximum of 5%. A second protective zone II, on the other hand, can in general be a Cr/Fe/Ni alloy which, however, should contain at least 60% chromium. Moreover, protective coatings can also be produced with other staggered sequences of layers. The practical variation possibilities are only limited by the compatibility of the layers with each other, such as by their expansion coefficients, and the like.

Said first layer or zone may have a thickness of 20–120$\mu$ and said second layer or zone have a thickness of 30–100$\mu$.

Multi-layer systems and anti-corrosion mechanisms are created by the protective coatings according to the invention. The coatings have zone structures which permit the maximum utilization of the combined materials by their optimizable design targeted for each case of application, and guarantee in their cumulative effect a wide spectrum of anti-corrosive behavior and high operating temperatures. This is particularly shown by an increased corrosion resistance vis-a-vis sulfur-containing agents and in an extended life of the workpiece.

Multi-layer protective coatings can be used in an especially advantageous manner in machine and appliance construction, particularly for components of thermal engines under high thermal and corrosive stress. A preferred field of application is, in this context, represented by the gas turbine and its accessories whereby a wide field opens up for combustion chambers, entrance buckets, moving blades and the like.

Having now generally described this invention, a better understanding can be obtained by reference to certain specific examples which are included herein for purposes of illustration only and are not intended to be limiting unless otherwise specified.

EXAMPLE 1

Figure 2:
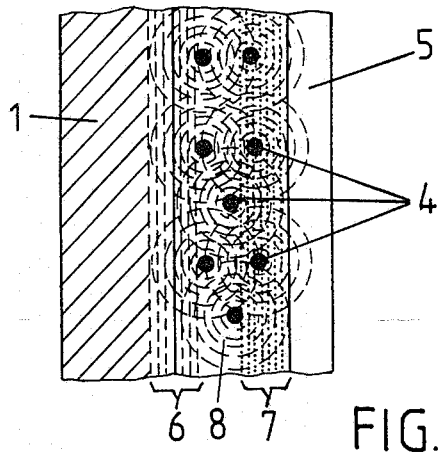
FIG. 2 shows the cross-section through a completed protective coating after the layers forming a second protective zone have been applied, wherein an additional structural layer of chromium 5, forms the protective zone II. Due to the pack-chroming effect at various temperatures, several diffusion zones have formed. Diffusion zone 6 between base material 1 and nickel matrix 3 has a relatively high nickel content, while the protective zone I in diffusion zone 7 beneath structural coating 5 of chromium (which is protective zone II) is essentially a nickel/chromium alloy of a variable composition. Diffusion areas or regions 8 of Zr/Ni alloy with a variable zirconium content exist around the zirconium particles 4, whereby the protective zone I, 7, is constituted therein.

This example represents the formation of a coating illustrated by FIGS. 1 and 2.

A gas turbine blade of a nickel super-alloy (trade name IN 738 LC) as base material 1 was first degreased and anodically pickled in 20% sulfuric acid. In order to improve the adhesion of the subsequent layer, the base material 1 was provided with a galvanically separated nickel intermediate layer 2 of a thickness of 3 to 4$\mu$. The nickel bath provided for this purpose had the following composition:

300 g $NiCl_2$/1 liter $H_2O$
60 g HCl/1 liter $H_2O$

The temperature during Ni deposition was 20° C., the current density was 3.6 A/dm$^2$ and the duration was 15 minutes. The blade nickeled in this manner was now placed into an additional nickel for the purpose of simultaneous galvanic separation of a nickel matrix 3, with zirconium particles of a maximum grain size of 5$\mu$ being held in suspension in said nickel bath by means of a mechanical stirrer. The nickel bath had the following composition:

600 g nickel sulfamate/1 liter $H_2O$
5 g $NiCl_2$/1 liter $H_2O$
30 g $B_2O_3$/1 liter $H_2O$
500 g zirconium particles/1 liter $H_2O$ The temperature was 20° C., the current density 5 A/dm$^2$ and the duration was 2 hours. The thickness of the separated layer forming a protective zone I amounted to approximately 120$\mu$. Approximately 10 to 15% finely dispersed zirconium particles 4 were embedded into the nickel matrix 3. Subsequently, the blade was annealed at a temperature of 1040° C. for ½ hour in a hydrogen atmosphere. The subsequent step was the chroming after the packing process at a temperature of 1050° C. for 6 hours whereby a reaction chamber was used which, besides chromium-containing powders and ammonium chloride, also contained alumina as inert filler. During this process, a structural layer 5 of chromium develops outside having a thickness of approximately 30μ to 100μ which represents the main constituent element for protective zone II. Owing to the thermal treatment, diffusion zones 7 and 8 develop additionally. The diffusion zone 6 between the base material and nickel matrix 3 has, in general, a thickness of 5μ to 10μ while the diffusion zone 7 (protective zone I) under the chromium structural layer 5 has a thickness of approximately 40μ. At its bordering surface towards the chromium structural layer, its chromium content amounts to approximately 40 to 50% and decreases towards the inside successively to zero. Additionally, around each zirconium particle 4, a concentric, spherical "corona-like" diffusion area 8 is formed of a Zr/Ni alloy with a variable zirconium content by having a portion of the zirconium dissolved in the nickel matrix 3. The remainder is maintained in particle form in the plant for a possible later supply. As a last step in the process, a thermal treatment adapted to the base material 1 was performed. In the case of In 738 LC, it was a solution treatment effected at 1130° C. for 2 hours with subsequent precipitation at 850° C. for 24 hours. The principal zonal structure of the multi-layer protective coating was no longer substantially changed by this final thermal treatment even though certain shiftings in the concentration gradients of the diffusion zones may occur.

Principally, the multi-layer, high-temperature corrosion protection coating consists of the two protective zones I and II. In this connection, the zones enter, in general, into function in their effect successively in time or are in interaction with each other. The high chromium-containing zone II first takes over the protective function but acts at the same time, as the supplier for zone I. The latter has only its full effect when zone II is removed owing to progressive corrosion or erosion attacks or by means of other effects. By means of parallel diffusion processes, particularly on the part of the zironium and chromium, a constant recuperation of the protective coating is effected so that its effective thickness is at least maintained or can even increase during operation.

EXAMPLE 2

Figure 3:
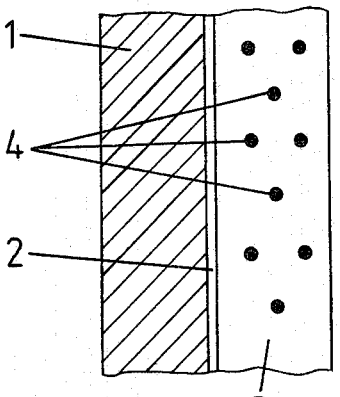
FIG. 3 shows the cross-section through a protective coating after the first two layers are applied wherein the figure and reference symbols correspond exactly with the conditions of FIG. 1.

See FIGS. 3 to 6. A gas turbine blade of a nickel super-alloy (Trade Name IN 738 LC) as the base material 1 was, in the manner mentioned in Example 1, degreased, pickled and provided with a galvanically separated first nickel intermediate layer 2 and with an also galvanically applied nickel matrix 3 with dispersed zirconium particles 4. FIG. 3 shows the cross-section of this condition. Subsequently, the blade was annealed in hydrogen in accordance with Example 1. After the degreasing of the surface, the blade was additionally galvanically chromed. The chromium bath had the following composition:

240 g $CrO_3$/1 liter $H_2O$ (Make: SRHS HC 20 from M+D)

Figure 4:
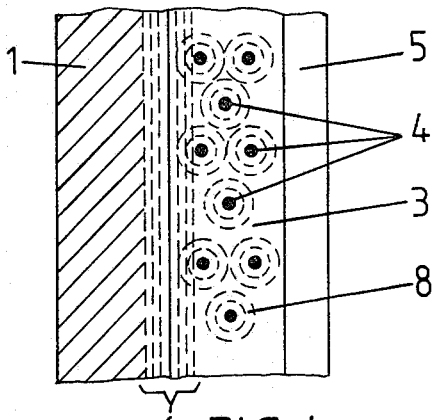
FIG. 4 shows the cross-section through a protective coating after a third layer has been applied, wherein the reference symbols and the zone structure correspond to FIG. 2. Diffusion zones 6 and 8 have come into existence through thermal treatment. The subsequent galvanic application of a chromium layer 5 does not yet result in a diffusion zone between said chromium layer 5 and nickel matrix 3.

The temperature amounted to 40° C., the current density to 50 A/dm$^2$ and the duration was 3 hours. The thickness of this chromium layer 5 amounted to approximately 80μ. This condition is represented in FIG. 4 after this stage of the process in a cross-section on a schematic basis. Subsequently a second nickel intermediate layer 9, having a thickness of 3 to 4μ, was galvanically applied in the manner indicated in the preceding example whereby the bath conditions were identical to those of the first nickel intermediate layer. Finally, an iron layer 10 with a thickness of approximately 10μ was also galvanically separated. The iron bath had the following composition:

330 g ammonium iron sulfate/1 liter $H_2O$.

Figure 5:
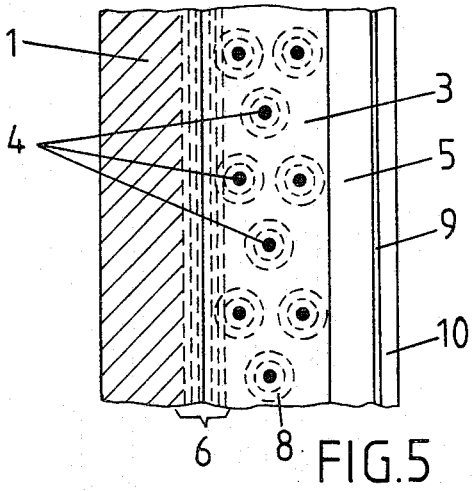
FIG. 5 shows the cross-section through a protective coating after two additional layers are applied, wherein the galvanically applied iron layer 10 of the protective zone II is placed on a thin second nickel layer 9 improving the adhesiveness. The remaining reference symbols correspond to preceding FIG. 4.
Figure 6:
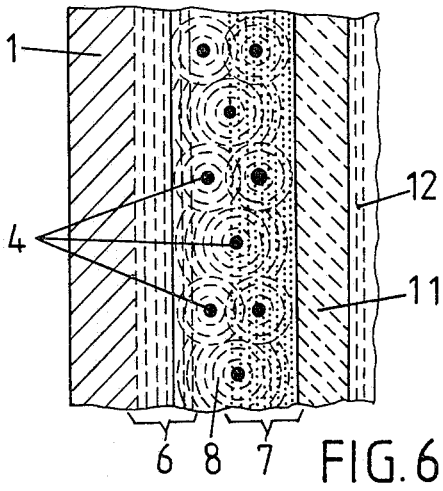
FIG. 6 shows the cross-section through a completed protective coating comprising several zones wherein after an additional thermal treatment, additional diffusion zones have appeared. A layer 11 of the protective zone II contains predominantly chromium while iron/-chromium alloy 12 on top of it delineates the protective zone II towards the surface. The remaining zones and reference symbols correspond to FIG. 2 or 5, respectively.

The temperature amounted to 40° C., the current density to 2 A/dm$^2$ and the duration was ½ hour. FIG. 5 shows the multi-layer protective coating in this state. As a final phase of the process, the blade was exposed to the same thermal treatment (1130° C./2 hours; 850° C.=24 hours) as indicated in Example I. This led to a number of diffusion zones. The already existing zone 6 between basic material and nickel matrix 3 was somewhat broadened while, at the same time, the earlier described zone 7 under the chromium layer developed into the protective zone I with a variable chromium content. The same applies to the diffusion area 8 around the zirconium particles 4. The protective zone II consists now of the layer 11 containing mainly chromium and the outer layer which consists of an Fe/Cr alloy 12. At the border line between 7 and 11, a chromium content of approximately 40% develops after the described heat treatment which recedes to practically zero at a depth of about 30μ of the diffusion zone 7. The zirconium content dissolved in the nickel is still at the original points as finely dispersed particles 4. The protective zone I has, accordingly, a mean zirconium content of 15% corresponding to the initial layer (coating before the diffusion).

In principle, what has been said in Example I applies to the multi-layer coating. During operation, a re-supply of the chromium as well as the zirconium is effected so that the originally existing concentration differences are reduced. The corrosive behavior vis-a-vis pure chromium is further improved by the Fe/Cr alloy 12 and the adjustment to an optimum chromium content is facilitated in the protective zone II.

In order to obtain information on the corrosive resistance of the innermost protective zone alone, crucible corrosion tests and comparative tests were performed with corresponding alloys and with known materials. By doing so, the point of departure was always the Zr/Cr/Ni system and individual components were substituted in additional tests or the alloy was doped with other additives. In this way, the advantageous effect of such substitutions and dopings can be transferred, in an analogous manner, to the multi-layer coatings.

EXAMPLE 3

A Zr/Cr/Ni alloy was produced in a melting-metallurgical manner by weighing and melting the below listed components in a pure clay crucible:

Zr in the form of powder (purity 99.5%): 10 g

Cr in the form of powder (purity 99.5%): 20 g

Ni as pellets (purity 99.5%): 70 g

The melting-down was effected inductively in an argon atmosphere within a period of 10 minutes. The melted mass was maintained at a temperature of 1600° C. for approximately 2 minutes and, subsequently, poured into a copper mold with an inner diameter of 15 mm. The cold sample had the following composition:

10% Zr

20% Cr

70% Ni

Crucible corrosion tests were performed with this alloy in an aggressive fused salt bath at a temperature of 850° C. As a comparison, a parallel sample of the corrosion-resistant nickel super-alloy with the trade name IN 939, as applied to gas turbine blades, was used. The bath of the corrosive medium was composed of 2 parts "A" and "B" wherein "A" consisted in turn of 2 components. The following mass or mol relations existed:

| | |
|---|---|
| "A" | = $V_2O_5/Na_2SO_4$ |
| "B" | = NaCl |
| "A":"B" | = 2:1 (mass relation) |
| $V_2O_5$:$Na_2SO_4$ | = 1:1 (mol relation). |

Small plane-parallel plates of 10×7×5 mm were prepared from the mentioned samples by cutting and grinding. Nine of such small plates were placed into a firebrick provided with corresponding holes and approximately 0.3 g of the corrosive medium was strewn over it. The samples prepared in this way were subsequently exposed to a temperature of 850° C. in a resistance furnace, chilled in water to room temperature in intervals of 24 hours and, always after the chilling, again strewn with 0.3 g of the corrosive medium and put back into the furnace. The entire test period covered 300 hours. After the test, the samples were metallographically examined in their cross-ground section and the ratio of initial to remaining cross-section or the taken-down depth were determined. A slight taking-down of the depth represents a good corrosion resistance.

On an average, the comparison resulted in the following values for the taken-down depth:

| Zr/Cr/Ni alloy | IN 939 |
|---|---|
| 0.49 mm | 1.5 mm |

The super-alloy IN 939 has the following composition:

| | |
|---|---|
| 0.15% | C |
| 0.15% | Si |
| 0.16% | Mn |
| 0.30% | Fe |
| 0.07% | Zr |
| 22.4% | Cr |
| 19.1% | Co |
| 3.7% | Ti |
| 1.85% | W |
| 1.9% | Al |
| 1.0% | Nb |
| 1.4% | Ta |
| 0.009% | B |
| Remainder | Ni |

Alloys of the following composition also proved to be favorable as coats:

| | |
|---|---|
| 8 to 12% | Zr |
| 18 to 22% | Cr |
| 0.05 to 0.5% | Y |
| Remainder | Ni |

EXAMPLE 4

Zirconium can partially be replaced by titanium whereby additional very favorable alloy coats are obtained having the following composition:

| | |
|---|---|
| 4 to 6% | Zr |
| 4 to 6% | Ti |
| 18 to 22% | Cr |
| 0.05 to 0.5% | Y |

The following alloy was obtained by melting using the above given process:

| | |
|---|---|
| 5% | Zr |
| 5% | Ti |
| 20% | Cr |
| 70% | Ni |

This alloy produced the following value for the taken-down depth, on the average, using the aforementioned crucible corrosion test:

0.30 mm.

EXAMPLE 5

To the Zr/Cr/Ni base alloy it is possible to add additional elements as doping agents. For this purpose it is appropriate to add certain alkaline earth metals and yttrium either in elemental or oxidized form. Following the description of Example 3, the following alloy was obtained by melting:

| | |
|---|---|
| 10% | Zr |
| 20% | Cr |
| 0.5% | $Y_2O_3$ |
| 69.5% | Ni |

The taken-down depth in the crucible test was:

0.43 mm

EXAMPLE 6

The element beryllium can also be added to the basic Zr/Cr/Ni alloy as a doping agent. The following alloy was obtained by melting using the above given process:

| | |
|---|---|
| 10% | Zr |
| 20% | Cr |
| 1% | Be |
| 69% | Ni |

The taken-down depth in the crucible test amounted to:

0.42 mm

EXAMPLE 7

Since the above investigated alloys are used as the innermost zone I of multi-layer coatings for components under high thermal and chemical stress, the possibility or even the necessity may arise under certain circumstances, depending on the process of application on the base material, of using additional elements for the basic alloy. The so called sinter additives represent an example. They are mostly used to obtain layers of a higher density when applying them through flame spraying, plasma spraying, etc. Known sinter additives are silicon and boron. In order to investigate their influence, the following alloy was prepared through melting:

| | |
|---|---|
| 10% | Zr |
| 20% | Cr |
| 3% | Si |
| 1.8% | B |
| 65.2% | Ni |

The taken-down depth in the crucible test amounted to:

0.48 mm.

This shows that the customary sinter additives have practically no effect on the high-temperature corrosion resistance of the basic alloy Zr/Cr/Ni.

EXAMPLE 8

A gas turbine blade of a nickel super-alloy (trade name IN 738 LC) was cleaned, degreased and subjected to a surface treatment by sand blasting. After the gas turbine blade, prepared in this manner, had been preheated to a temperature of 120° C., it was coated using the plasma application process in a protective gas atmosphere (argon) and by utilizing a metal powder mixture. The powder had a grain size from 40μ and 50μ and had the following composition:

| | |
|---|---|
| 14% | Zr |
| 20% | Cr |
| 3% | Si |
| 2% | B |
| 61% | Ni |

In this instance, the actually effective corrosion protection zone I is formed by the alloy consisting of the three substances Cr/Zr/Ni while the silicon and the boron mainly take over the function of sinter additives for the subsequent dense-sintering. The layer applied in the case under consideration had a thickness of 120μ. After the mechanical removal of the superfluous sprayed material, the primarily applied protective layer was dense-sintered under vacuum by the thermal treatment of the coated blade. The temperature amounted, in this case, to 1050° C. and the duration was 2 hours. Subsequently, the blade was subjected to a treatment by mud blasting in order to reduce the roughness of the surface. The corrosion protection zone I produced in this manner had the following composition and structure:

| | |
|---|---|
| Substances dissolved in the matrix: | 20% Cr |
| | 3% Si |
| | 2% B |
| | 10% Zr |
| | 61% Ni |
| Particles finely dispersed in the matrix: | 4% Zr |

Chroming according to the packing process as well as the thermal treatment according to Example 1 were the next steps used in the process.

Having now fully described this invention, it will apparent to one of ordinary skill in the art that many modifications and changes can be carried out without changing the spirit or scope of the invention thereof:

What is claimed as new and intended to be covered by Letters Patent is:

1. An article for use at high operating temperatures comprising a base material which is a metal, suitable for high temperature application, whose outer metallic surface forms a surface of the article when unprotected by a protective coating but whose outer surface is corrodible at high operating temperatures when unprotected, said metal being one into which nickel can diffuse at high operating temperatures and a multi-layer, high-temperature corrosion protection coat upon the corrodible metallic surface which comprises:

(a) first protective layer adjacent to said metallic surface said layer having a nickel containing matrix and comprising 1–15% zirconium alone, or a mixture of zirconium and of up to 80% titanium replacing zirconium, present at least in part as fine particles disposed in said matrix, 10–30% chromium, optionally 0.05–2% yttrium, lanthanum, rare-earth and/or berylium, up to 4% silicon, up to 2% boron, and remainder essentially nickel;

(b) a second protective layer adjacent to said first protective layer comprising at least 60% chromium and remainder selected from the group consisting of iron, iron plus nickel and mixtures thereof;

(c) a diffusion zone of high nickel content extending from the base material into the first protective layer (a);

(d) a diffusion zone which is a nickel chromium alloy of variable constitution within the first protective layer (a) and beneath the second protective layer (b) and;

(e) diffusion regions of zirconium nickel alloy of variable zirconium content surrounding the zirconium particles;

the proportions of the metals in the protective layers (a) and (b) being the proportions before the creation of the diffusion zones.

2. The article of claim 1 wherein up to 80% of said zirconium is replaced by titanium.

3. The article of any of claims 1 or 2 wherein said first layer further comprises 0.05–2% of an additive selected from the group consisting of beryllium, yttrium, lanthanum, a rare earth, oxides thereof and mixtures thereof.

4. The article of any of claims 1 or 2 wherein said first layer further comprises 3–4% silicon and 1.5–2% boron.

5. The article of claim 1 wherein said first layer comprises 8–12% zirconium, 18–22% chromium, 0.05–0.5% yttrium and remainder nickel.

6. The article of claim 5 wherein said first layer further comprises 3–4% silicon and 1.5–2% boron and remainder nickel.

7. The article of claim 1 wherein said first layer comprises 14% zirconium, 20% chromium, 3% silicon, 2% boron and remainder nickel.

8. The article of claim 1 wherein said first layer has a thickness of 20–120μ and said second layer has a thickness of 30–100μ.

9. The article of claim 1 wherein said coat comprises an outer layer adjacent to second layer (b) wherein said outer layer is an alloy comprising iron and chromium which has diffused from the second layer (b) into the iron of the outer layer, thereby forming a two layer second layer.

10. The article of claim 9 wherein said first layer has a thickness of 20–120μ, said two layer second layer has a thickness of 40–120μ and wherein said two layer second layer comprises two layers, the first being layer (b) containing chromium and having a thickness of 30–110μ and the second being the outer layer comprising an iron/chromium alloy having a thickness of 10μ.

11. The article of claim 1 or 7 wherein said base material is a nickel super-alloy, said first layer (a) has a thickness of 20–120μ and said second layer (b) has a thickness of 30–100μ.

* * * * *